United States Patent [19]

Fetzer

[11] 4,037,914

[45] July 26, 1977

[54] ELECTRICAL CONNECTOR AND CONNECTOR CABLE

[75] Inventor: Martin Fetzer, Stuttgart, Germany

[73] Assignee: Robert Bosch G.m.b.H., Stuttgart, Germany

[21] Appl. No.: 627,051

[22] Filed: Oct. 30, 1975

[30] Foreign Application Priority Data

Nov. 14, 1974 Germany ..... 37955

[51] Int. Cl.[2] ..... H01R 13/54

[52] U.S. Cl. ..... 339/253 R; 339/147 R; 339/223 S

[58] Field of Search ..... 339/26, 28, 29, 223, 339/253, 254, 256, 258, 147, 149, 153, 154

[56] References Cited

U.S. PATENT DOCUMENTS

| | | | |
|---|---|---|---|
| 1,237,718 | 8/1917 | Speice | 339/258 C |
| 1,821,443 | 9/1931 | Mohr | 339/258 C |
| 1,984,526 | 12/1934 | Given | 339/147 R |
| 2,699,535 | 1/1955 | Flora | 339/258 C |
| 3,076,113 | 1/1963 | Candelise | 339/26 |
| 3,212,044 | 10/1965 | Cloud, Jr. | 339/223 S |
| 3,431,534 | 3/1969 | Schrader et al. | 339/256 C |
| 3,867,001 | 2/1975 | Hedman | 339/26 |

*Primary Examiner*—Joseph H. McGlynn
*Attorney, Agent, or Firm*—William R. Woodward

[57] ABSTRACT

The ignition cable of a motor vehicle engine is permanently connected at each end to the shell component of a connector. Each shell is of the same design and has sawtooth catch ridges. A mating plug connector, for example a apart of an interposed connector housing an interference suppression resistor and fitting onto an electrical component such as a spark plug, distributor cap, spark coil or the like, likewise, has sawtooth catch ridges so that the force for joining the shell and plug is substantially less than necessary for pulling them apart. The steeper sides of the catch ridges on the plug, however, are less steep when the plug is a connection stud of an electrical component of the ignition system, such as the distributor cap, spark coil or the like, so that when the ignition cable is pulled, the cable or interposed connector will come off the distributor cap or spark plug without separating the cable from any detachable "interposition" connector that may be connected to the cable.

2 Claims, 2 Drawing Figures

ELECTRICAL CONNECTOR AND CONNECTOR CABLE

This invention relates to an electrical connector and also to a connector cable having certain connector components at its respective ends. In particular, the invention concerns a connector for a cable such as a piece of automobile ignition cable comprising a connector socket and a connector plug, the socket being permanently connected to the cable conductor and plug, at least at one end of the cable being a detachable intermediate plug unit fashioned so as to fit on a spark plug terminal or other circuit component terminal. The socket component of the connector is provided with catch ridges to engage circumferential grooves or screw threads of the plug component.

An electrical connector for connecting a cable to a circuit component of an electrical system through an intermediate plug unit is known in which the socket component is provided with catch ridges oriented for alignment with screw threads. The connector socket in this case is permanently connected to an ignition cable and it is designed to be engaged axially, directly onto a threaded connection stud of a spark plug. The threads of the stud have a symmetrical profile as seen in a cross-sectional plane passing through the axis of the screw threading and, thus, define symmetrical nesting cavities or grooves for the catch ridges of the socket. In consequence, the connector socket requires application forces and removal forces of essentially the same magnitude, even for catch ridges of asymmetric profile. It is, however, often desirable to require greater removal force than application force, in order that the socket should be easy to put on to a connection stud and to assure that it will thereafter be held sufficiently securely on the connection stud, particularly in the case of the severe operating conditions in a motor vehicle, while also allowing its removal a number of times without excessive wear of the crests of the threading. Furthermore, in the known electrical connectors, the connector socket provided on the end of an ignition cable is designed to be put directly on to the spark plug. In consequence, for the necessary suppression of disturbing radiation generated at the spark plug, the spark plug itself must be provided with interference suppression. This makes the spark plug complicated and expensive.

It is an object of the invention to provide an electrical connector which requires greater removal force than application force, so that the connector socket can be easily put on and will also remain securely on the plug component even after repeated removal and reapplication and, moreover, will not produce wear on the plug.

SUMMARY OF THE INVENTION

Briefly, the catch grooves of the plug define more or less circumferentially directed ridges, either normal to the plug axis or helical, of which the slopes determining the application forces for the socket component are of less inclination to the plug-and-socket axis than the slopes determining the removal forces required for removal of the socket component, whereby removal forces larger than the application forces are necessary.

In addition, since various electrical connections require application and/or removal forces of varying size which must be effective with the same socket component of the connector, it is advantageous to provide plug components with ridge slopes that are suited to the particular application and removal forces, so that a number of plug components may be available with different ridge slope ratios for use with identical socket components.

In a particular form of the invention, the socket component of the connector is permanently connected to one end of an ignition cable and the plug component of the connector is an intermediate connection plug unit containing an interference suppression resistor and an additional connector socket for engagement with a spark plug terminal. It is also advantageous, where it is desirable to provide the distributor of an engine ignition system with an interference suppression resistor, to provide a similar intermediate connection plug unit containing an interference suppression resistor at the distributor cable connection.

On the other hand, where interference suppression is provided elsewhere in the circuit, a socket component permanently connected to an ignition cable may be engaged with a plug component in accordance with the invention that is fixed and serves as the connection terminal stud of a distributor of an engine ignition system.

In a further development of the invention, for reducing the variety of connection components, the connector socket components permanently connected to the ignition cable at the two ends of the latter are/of identical form and one engages a plug component in the form of an intermediate connector plug unit fitting onto a spark plug, while the other engages a connector plug component that is either an intermediate connector component fitting onto a connection stud of a distributor or is itself the connection stud of a distributor.

Disconnecting the ignition cables of an engine is commonly done by pulling on the cable itself at its most easily reached part. In order to prevent that such a pull would separate the cable from some intermediate plug unit that may be in the system, leaving it on the spark plug or other circuit component, instead of making the separation at the spark plug and/or distributor, for example, it is desirable to design the connector of the present invention so that the forces required for pulling it apart are greater than those required for pulling the connector plug unit off the spark plug terminal, distributor terminal, or other electrical component served by the cable. This principle requires provision of a relatively high separation force for the socket and plug connector members holding an intermediate plug unit to the cable, which means a relatively steep inclination to the connector axis of the rear slope of the circumferential ridges on the plug, which faces away from the wire-holding end of the socket. Although the catch ridges of the socket are commonly of sawtooth profile, this has been found ineffective to provide a sufficient difference between required applications and removal forces if the plug ridges are symmetrical.

If a socket of the same design is used to engage a plug member which is itself a terminal stud of a component to be connected, such as a distributor in an ignition system, the plug member in that case should be designed for somewhat lower separation force requirement, which is to say that the rear slope of its circumferential ridges, which faces away from the plug member extremity, should be less inclined to the plug axis than in the case previously mentioned, and as a limiting case may even have the same inclination as the slopes of these ridges which face towards the plug extremity.

BRIEF DESCRIPTION OF THE DRAWINGS

The invention is further described by way of illustrative example with reference to the accompanying drawings, in which.

DESCRIPTION OF THE PREFERRED EMBODIMENTS

Figure 1:
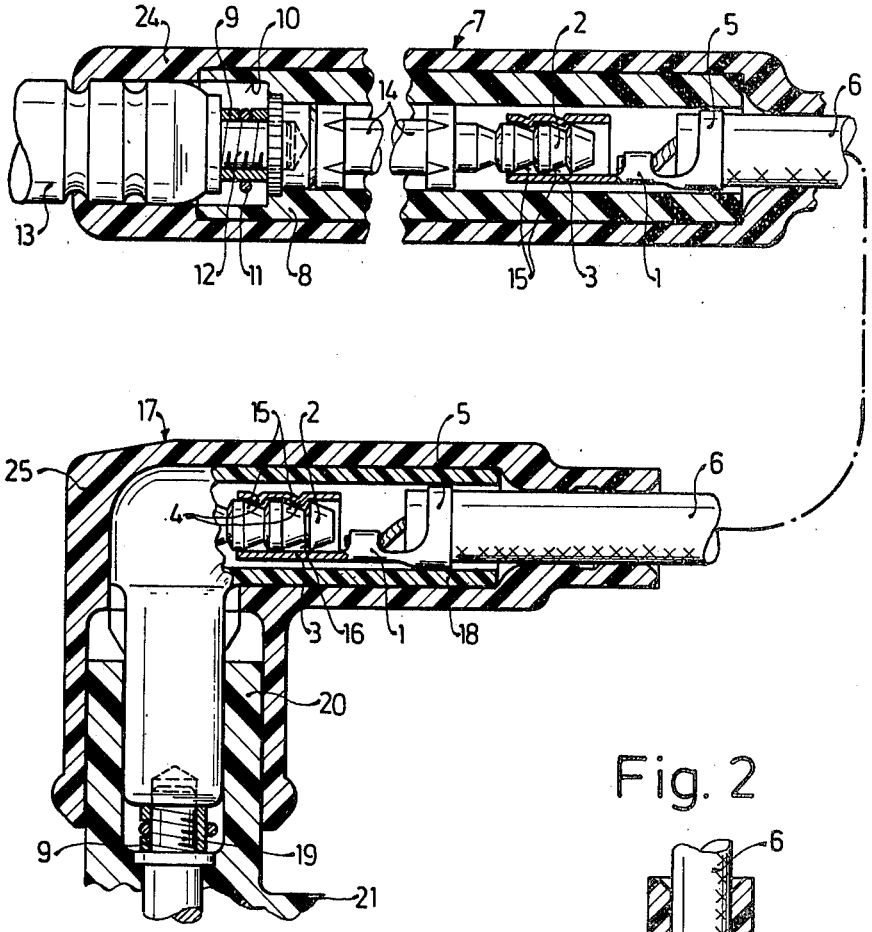
FIG. 1 is a side view, mostly in section, of connectors provided at the end of an ignition cable in accordance with the invention for making connection to a spark plug and to a distributor, omitting the cable except for tis extremities.

The electrical connector of the present invention illustrated in FIG. 1 comprises a connector socket 1 in its fully engaged position on a plug connector member 2. The socket 1 is provided with catch ridges 4 projecting inwardly on the inside of its cylindrical portion 3. As shown in FIG. 1, these catch ridges do not extend all the way around the circumference of the cylindrical portion, in order to allow sufficient detachability. As shown in FIG. 1, the socket member 1 comprises, in addition to the cylindrical portion 3, a connection tab or extension 5 to which an end of the conductor of an ignition cable 6 is crimped.

The connector plug member 2 of the connector shown in the upper part of FIG. 1 is part of a unit 7 designed to serve as a spark plug connector and the unit 7 accordingly comprises an insulating body 8 in which a hollow contact member 9 is seated in a spark plug connection cavity 10 for connection with a spark plug as shown in FIG. 1. The contact member 9, which is an additional socket connector, carries a stop spring 11 that catches either between the threads of a threaded spark plug connection stud 12 or in a ring groove of a circumferentially grooved connection stud 12 of a spark plug 13 when the spark plug connector unit 7 is seated on the end of the spark plug 13.

As illustrated in FIG. 1, the contact member 9 is electrically connected to an interference suppression resistor 14 that is likewise mounted inside the insulating body 8. The connector plug member 2 is similarly connected electrically to the other end of the interference suppression resistor 14.

The plug member 2 is provided with threads or circumferential ridges of sawtooth profile. The front slopes 15 of the sawtooth ridges, facing the plug extremity, have relatively small inclinations to the plug axis, so that they make possible the application of the connection socket 1 with small application force. In contrast, however, the rear slope 16 acting as a catch projection is relatively steep, that is, it has a relatively large inclination to the plug axis and a small inclination to the plane perpendicular to the plug axis. Hence, when the catch ridges 4 of the connector socket 1 are nested behind the catch projection surfaces 16, substantially greater removal forces must be exerted to pull the socket 1 off the plug member 2 than are necessary to pull the spark plug connector 7 off the connection stud 12 of the spark plug 13.

At the other end of the ignition cable 6, another connector socket 1 is crimped onto the conductor. This socket is shown in FIG. 1 in its engaged position on a suppressor plug 17 for a distributor. The distributor suppressor plug 17 has an insulating body 18 in which are provided the contact member 9, another interference suppressor resistor 14 that does not appear in the drawing, and the connector plug member 2, electrically connected together in the same manner as in the spark plug connector 7. The distributor suppressor plug 17 is applied to and seated on a terminal stud 19 mounted in the connection structure 20 of a distributor cap 21, only part of which is shown in the drawing, the remainder of the distributor also being omitted in the drawing. The connection stud 19, like the connection stud 12 of the spark plug 13, is provided with threads or with ring grooves. The connection between the distributor suppressor plug 17 and the connection stud 19 is, again, designed to require removal force of the same magnitude as for removal of the spark plug connector 7 from the spark plug 13. These removal forces are in each case substantially smaller than the removal forces necessary to pull the socket 1 respectively away from the spark plug connector 7 and away from the distributor suppressor plug 17.

Figure 2:
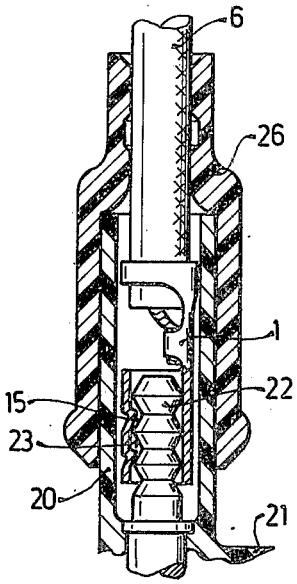
FIG. 2 is a similar side view, mostly longitudinal in section, of a connection according to the invention directly between a cable and a distributor terminal without an intermediate connector plug unit.

FIG. 2 shows a second illustrative embodiment of a connector utilizing a connector socket 1 identical to the sockets 1 shown in FIG. 1, this time engaged directly on a holding terminal plug 22 extending from the connection terminal structure 20 of the ignition distributor cap 21, it being assumed in this case that interference suppression is being taken care of at other locations in the ignition system, so that a suppressor plug such as the suppressor plug 17 is not in this case necessary. Evidently, a similar direct connection of an ignition system component to the cable could be used for connection to an ignition coil. In order that in the case of FIG. 2 the condition should also be satisfied that greater pull-off forces are necessary to pull the cable 6 off the spark plug connector 7 than to pull the spark plug connector 7 off the spark plug 13 or to pull the cable 6 off the distributor cap 21, even when the connector socket 1 has the same form at both ends of the ignition cable, all that it is necessary to provide is to modify the shape of the catch ridges 23 of the holding plug 22, without changing the inclination of the slope 15 on which the ridges of the socket 1 ride up as the socket is applied. Only the slopes that determine the seating or catch angle are changed, these having a smaller inclination to the plug axis, so that the catch ridges 4 of the socket 1 can be more easily pulled forward over the plug ridge surfaces 23 and require smaller removal force than those necessary in the case of the ridge slopes 16 of FIG. 1.

With the design of electrical connectors according to the present invention, it is possible to provide reliable and economical latching type high voltage connections with simple means, particularly well suited for connections between an ignition cable and a spark plug connector and, likewise, between an engine ignition cable and either a distributor suppressor plug or a distributor terminal. As already noted, although the removal force required to separate the cable 6 from the suppressor connection plugs 7 and 17 are greater than those necessary for separating the cable 6 from the distributor connection stud 22, the connector socket 1 that is used is in each case of identical design, which provides manufacturing economy for this part.

The required separation force for the latching connection between the socket 1 and the plug 2 in one case and the plug 22 in another, remain constant even after repeated pulling off of the socket 1, because the catch and ridge slopes 16 and 23 receive hardly any wear in comparison to connections with screw threads of symmetrical profile used as holding ridges. The shape of the holding ridge surfaces 23 is also suitable for the usually desired construction of the distributor connection stud 22 utilizing brass as a material.

Even when the sawtooth ridges 15, 16 and 16, 22 have the form of screw threads of sawtooth profile alternating with correspondingly shaped grooves, so that the threads require greater force than aplication force for a connector shell of the form of the socket 1, the structure is suitable for electrical connectors in accordance with the invention. In this case also the slopes of the threads facing in one direction and in the other, respectively, can be made different so as to change the removal force and bring it up to the necessary magnitude. The holding ridge slopes 16 can also be provided in part in such a way that the sockets 1 at the ends of the cable 6 can be released from the plug members 2 only by unscrewing, in which case they make a truly latching connection.

The latching or holding connection locations are in each case protected against moisture and dirt by highly flexible elastic sealing shells. A protective shell 24 is provided on the outside of the spark plug connector 7 which overlaps the end of the spark plug 13 and also the end of the cable 6. The distributor suppressor plug 17 also has a flexible protective shell 25 one end of which fits over the terminal structure 20 of the distributor cap 21 and another over the end of the cable 6. Likewise, a protective shell 26 surrounds the connector socket 1 seated directly on the distributor connection stud 19 and extends over the end of the terminal structure 20 of the distributor cap 21 in FIG. 2.

The present invention provides a new type of electrical connector particularly suited for a relatively strong but easily made holding connection between a cable and an intermediate connector unit that may house an electrical component to be inserted at the connection, and also provides a particularly useful cable assembly suitable for high voltage connections of an engine ignition system and comprising a cable, connector sockets of identical design permanently connected to each end of the cable and a plug unit in the form providing electrical component insertion, which unit is assembled relatively firmly, but removable, at an end of the cable.

When the plug member of the connector of the invention has helical ridges and grooves (i.e. screw threads), the pitch should generally be less than 30° for good axial holding with a slip-on connector socket, preferably less than 15°. The catch ridges of the socket connector, since they occupy only a small circumferential extend of the socket connector, do not have to be exactly in alignment with the orientation of the plug ridges, so long as they are within about 15° of the alignment.

Although the invention has been described with reference to particular illustrative examples, therefore, variations and modifications are possible within the inventive concept.

I claim:

1. An electrical connector cable comprising an insulated conductor connected at each end to an electrical connector comprising a connector socket and a connector plug, each connector socket being permanently electrically connected to said conductor by an extension of the socket and having inwardly projecting catch ridges on a substantially cylindrical metallic socket portion, the two connector sockets being identical in configuration, each connector plug having an engagement surface substantially in the shape of a surface of revolution about its longitudinal axis providing substantially circumferential grooves and inter-groove ridges, the plugs being engaged in each case in one of said sockets and the ridges of said plugs being engaged with the catch ridges of that one of said sockets and at least one of said plugs having forward and rear slope inclinations differing from each other, the former being the greater, whereby the force required for disengagement of said socket and plug is substantially raised relative to the force required for their engagement, the engagement surfaces of one of the plugs being different from those of the other so that different amounts of force are required for their respective disengagement from the corresponding socket.

2. An electrical connector cable as defined in claim 1, in which the engagement surfaces of both of said plugs are in the shape of a coarse screw thread of a pitch not exceeding 30° and in which the profile of said screw threads on that one of said plugs which requires the lesser amount of force for its disengagement from the corresponding socket is substantially symmetrical.

* * * * *